US006164287A

United States Patent [19]

White

[11] Patent Number: 6,164,287

[45] Date of Patent: Dec. 26, 2000

[54] SMOKING METHOD

[75] Inventor: Jackie Lee White, Pfafftown, N.C.

[73] Assignee: R. J. Reynolds Tobacco Company, Winston-Salem, N.C.

[21] Appl. No.: 09/100,660

[22] Filed: Jun. 10, 1998

[51] Int. Cl.[7] ..... A24F 47/00

[52] U.S. Cl. ..... 131/328; 131/194; 131/330

[58] Field of Search ..... 131/328, 330, 131/194

[56] References Cited

U.S. PATENT DOCUMENTS

| | | | |
|---|---|---|---|
| 2,104,266 | 1/1938 | McCormick . | |
| 4,133,301 | 1/1979 | Fujiwara . | |
| 4,393,884 | 7/1983 | Jacobs . | |
| 4,500,027 | 2/1985 | Nakajima . | |
| 4,552,124 | 11/1985 | Nakajima . | |
| 4,597,732 | 7/1986 | Yoshinaga . | |
| 4,765,347 | 8/1988 | Sensabaugh . | |
| 4,765,348 | 8/1988 | Honeycutt . | |
| 4,774,971 | 10/1988 | Vieten . | |
| 4,836,225 | 6/1989 | Sudoh . | |
| 4,938,236 | 7/1990 | Banerjee et al. . | |
| 4,947,874 | 8/1990 | Brooks et al. . | |
| 4,952,138 | 8/1990 | Ho . | |
| 4,955,399 | 9/1990 | Potter et al. . | |
| 4,981,522 | 1/1991 | Nichols et al. | 131/274 |
| 5,016,654 | 5/1991 | Bernasek et al. . | |
| 5,038,802 | 8/1991 | White et al. . | |
| 5,060,671 | 10/1991 | Counts . | |
| 5,093,894 | 3/1992 | Deevi . | |
| 5,144,962 | 9/1992 | Counts et al. . | |
| 5,224,498 | 7/1993 | Deevi . | |
| 5,240,012 | 8/1993 | Ehrman et al. | 131/194 |
| 5,249,586 | 10/1993 | Morgan . | |
| 5,269,327 | 12/1993 | Counts . | |
| 5,285,798 | 2/1994 | Banerjee et al. . | |
| 5,369,723 | 11/1994 | Counts . | |
| 5,408,574 | 4/1995 | Deevi . | |
| 5,499,636 | 3/1996 | Baggett . | |
| 5,573,692 | 11/1996 | Das et al. . | |
| 5,665,262 | 9/1997 | Hajaligol et al. . | |

FOREIGN PATENT DOCUMENTS

| | | |
|---|---|---|
| 0 339 658 A2 | 11/1989 | European Pat. Off. . |
| WO97/48294 | 12/1997 | Japan . |
| 2-086 206 | 5/1982 | United Kingdom . |
| WO 86/02528 | 5/1986 | WIPO . |
| WO 96/32854 | 10/1996 | WIPO . |

OTHER PUBLICATIONS

E. L. Wynder et al., A Study of Tobacco Carcinogenesis; *V. The Role of Pyrolysis*; J.Cancer, 11(6) 1140–48 (1958).

E.L. Wynder et al., Tobacco and Tobacco and Smoke, 127–31; 345–51 Academic Press 1967).

B.N. Ames et al., Mutation Research 31:347–64 (1975).

T. Yahagi et al., Cancer Lett. 1:91–97 (1975).

D.M. Maron et al. Mutation Research 113:247–56 (1983).

B.R. Bombick et al., Food & Chemical Toxicology 36:183–190 (1998).

*Primary Examiner*—Christopher A. Fiorilla

[57] ABSTRACT

A smoking article which employs tobacco as a source of smoke and flavor, but which does not burn the tobacco; the smoking article including a tobacco tablet, a heat conductor in contact with the tablet and a source of heat which heats the conductor in contact with the tablet to a pre-selected temperature for generating smoke. The invention also relates to a formed tobacco tablet for use in the smoking article.

6 Claims, 2 Drawing Sheets

SMOKING METHOD

BACKGROUND OF THE INVENTION

The present invention is directed to improvements in smoking articles, particularly smoking articles which employ tobacco as a source of smoke and flavor, but which do not burn tobacco.

Cigarettes, cigars and pipes are popular smoking articles which use tobacco in various forms. Many products have been proposed as improvements upon, or alternatives to, the various popular smoking articles. For example, numerous references have proposed articles which generate a flavored vapor and/or a visible aerosol. Most of such articles have employed a combustible fuel source to provide an aerosol and/or to heat an aerosol forming material. See, for example, the background art cited in U.S. Pat. No. 4,714,082 to Banerjee et al.

A number of smoking articles have been designed and produced having a short carbonaceous fuel element and a physically separate aerosol generating means. Smoking articles of this type, as well as materials, methods and/or apparatus useful therein and/or for preparing them, are described in the following U.S. Pat. No. 4,708,151 to Shelar; U.S. Pat. No. 4,714,082 to Banerjee et al.; U.S. Pat. No. 4,732,168 to Resce; U.S. Pat. No. 4,756,318 to Clearman et al.; U.S. Pat. No. 4,782,644 to Haarer et al.; U.S. Pat. No. 4,793,365 to Sensabaugh et al., and the patents cited in U.S. Pat. No. 5,546,965, the disclosure of which is incorporated herein by reference.

Other approaches have been taken to provide alternate smoking articles without burning tobacco, such as the use of electrical heaters to heat tobacco or tobacco flavor-containing materials to form an aerosol. See, e.g., U.S. Pat. No. 2,104,266 to McCormick, U.S. Pat. No. 4,735,217 to Gerth et al., U.S. Pat. No. 5,144,962 to Counts et al., U.S. Pat. No. 5,224,498 to Deevi et al., U.S. Pat. No. 5,249,586 to Morgan et al., U.S. Pat. No. 5,369,723 to Counts et al., and U.S. Pat. No. 5,499,636 to Baggett et al., and PCT publication No. WO 96/32854 of Baggett et al., published Oct. 24, 1966.

Another approach has been to use chemical reactions other than the burning of fuel to provide the heat for vaporization of tobacco components or tobacco flavor materials. See, e.g., U.S. Pat. No. 3,258,015 to Ellis et al. and U.S. Pat. No. 4,941,483 to Ridings et al. In U.S. Pat. No. 5,285,798 to Banerjee et al., an electrochemical approach to flavor generation was reported.

Other reported systems have included German patent No. 27 04 218 to Kovacs, which uses a flame or other heater to heat scented gas, which can then be inhaled to simulate smoking, and PCT publication No. WO097/48294 of Japan Tobacco, published Dec. 24, 1997. That PCT publication discloses a combination lighter/heat exchanger for heating air to elute flavorants, including tobacco ingredients such as tobacco extract ingredients or condensed tobacco smoke, from a substrate, which may be a solid raw material, or may be an air-permeable substrate, such as activated carbon fiber, cellulose fiber, etc. The eluted flavorants are drawn into the mouth of the smoker.

SUMMARY OF THE INVENTION

The present invention relates to novel smoking devices and methods which produce smoke from tobacco at low temperatures, without generating significant levels of complex byproducts. Yet the smoking devices of the present invention are capable of providing the user with the pleasures of smoking, (e.g., the smoking taste, feel, satisfaction and the like), without burning tobacco, without producing sidestream smoke or odor, and without generating inhalant products having activity as measured by the Ames test. See, e.g., Ames et al., *Mut. Res.* 31:347–64 (1975); Nagao et al., *Mut. Res.* 42:335 (1977) and 113:173–215 (1983). Preferably the device and method of the present invention do not generate positive "Ames activity," i.e., there is no significant dose response relationship between the inhalant product produced by the device of the present invention and the number of revertants occurring in standard test microorganisms exposed to such product. According to the proponents of the Ames test, a significant dose dependent response indicates the presence of mutagenic materials in the product tested.

The present method produces smoke from tobacco at a temperature which would be considered low when compared to the combustion temperatures normally encountered in burning tobacco, such as cigarettes, cigars and pipes, which can be in the range of 800–900° C. The method utilizes careful control of heat and temperature. Exposure of tobacco to constant temperature provides results which are reproducible from puff to puff over the time period that the smoke is formed, without substantial fluctuations of temperature due to puff volume or frequency. The method utilizes a source of constant, controllable heat to produce such results.

The smoke is formed from tobacco which has the physical characteristics such that, when exposed to the constant, controlled temperatures of the present invention, produces smoke which can be enjoyed, but which is free of Ames activity, and free, or essentially free, of products of incomplete combustion, such as carbon monoxide. This is accomplished by forming the tobacco, which is ground into a powder, into a high density, small volume piece, in order that the tobacco mass is heated at a constant temperature, with constant heat input.

One embodiment of the smoking articles of the present invention comprise a housing, preferably tubular in shape, a mouthpiece, a heat conductor located in the housing, a tobacco tablet in contact with the heat conductor, a heat source attached to the housing and including a supply of combustible gas, and a burner spaced from the heat conductor and arranged to heat the tobacco tablet in contact with the heat conductor to a pre-selected temperature for generating smoke from the tobacco, and one or more air inlets arranged for introducing air into the housing which permit the generated smoke to be drawn through the mouthpiece into the mouth of the smoker.

The term "tobacco" as used herein refers to material which is primarily tobacco plant product, but may include minor amounts of emollients, dressings, flavor enhancers such as tobacco extracts, binders, fillers etc. as commonly known in the art of blending tobacco products for cigarettes, cigars or pipe tobacco. See, e.g., Sensabaugh et al., *Tobacco Science* 11:25–30 (1967); Sittig, *Tobacco Substitutes* Noyes Data (1976); Leffingwell et al., *Tobacco flavoring for Smoking Products*, Winston-Salem N.C. 1972, and the materials listed in Perfetti et al. U.S. Pat. No. 5,137,034, which is hereby incorporated herein by reference. Preferred emollients include propylene glycol and triethylene glycol, which are preferably included in amounts of about 0.5% to about 20% by weight, more preferably about 1% to about 6% by weight. For example, the tobacco material can be cigarette dust, which is dust produced in the manufacture of cigarettes, and includes the various emollients, tobacco blends, dressings, binders and fillers which may have been included in the cigarette tobacco blend for improved flavor or consistency. The tobacco utilized herein may incorporate components of the tobacco-containing smokable filler material as described in U.S. Pat. No. 5,101,839 to Jakob et al.

Preferably, the tobacco is in the form of a thin tablet of compressed tobacco powder. The shape of the compressed tobacco powder preferably designed to ensure good contact with the conductor. Preferably, the compressed tobacco powder is in the shape of a tablet, disk or wafer.

The tobacco material utilized in the present invention should be of a size which can be easily compressed to produce a well formed tablet which can withstand the stress of packaging and handling without breaking or chipping. The tobacco material is preferably ground tobacco powder, which has been compressed, e.g. in a tableting die or extruded, to give it the desired shape, and sufficient strength to withstand physical handling without fracturing (e.g., chipping or breaking). Preferably the tobacco powder is formed by milling tobacco, e.g. in a ball mill, to a particle size (average diameter) of about less than about 20 microns, more preferably less than about 10 microns.

The present invention includes smoking apparatus which is designed and constructed to deliver very constant and controlled heat over the time and puffing sequence to which the tobacco material is exposed. The process is improved when the tobacco material is maintained in close contact with the heated surface used for raising and maintaining its temperature throughout the use of the device.

During the use of the smoking article, there may be minor variations of temperature, primarily when a puff is taken by the smoker. The puff removes the smoke and warm air surrounding the tobacco tablet, and brings in outside air through the air inlets, which will result in a reduction of temperature of the tobacco tablet. Preferably the mass of the conductor and the constant heat input to the conductor are such that the fluctuation of temperature during puffs is minimal, e.g. a drop of less than about 40° C., preferably less than about 20° C. and most preferably less than about 10° C. Thus the design is set to maintain a predetermined temperature constant within about 20%, preferably constant within about 10%, and most preferably constant within about 5%.

The preferred embodiments achieve this by using a compressed tablet of tobacco powder having a high aspect ratio, e.g. a ratio of width (diameter, if circular) to thickness of from about 3:1 to about 15:1, and having a flat surface which abuts a flat surface of a heated conductor. Thus the surface exposed to the heat is large compared to the thickness. This is important for heat conductance through the tobacco tablet to establish and maintain the uniform temperature of the tobacco tablet. On the one hand, the thicker the tablet, the poorer the heat transfer to release the smoke. Thick tobacco tablets can yield inefficient heat conductance by the tobacco tablet, in which case, smoke yield will be reduced. On the other hand, tobacco tablets having an insufficient mass of tobacco will also yield lower amounts of smoke. The preferred form is that of a circular tablet.

It is also preferred that the tobacco tablet have sufficient mass of tobacco to produce 6–10 puffs of smoke per use, comparable to the number of puffs obtained from most commercial cigarettes. The tobacco tablet should produce between about 1 to 25 mg of wet total particulate matter (WTPM) per 10 puffs, preferably 5 to 20 mg per 10 puffs, and most preferably between 7 to 15 mg per 10 puffs. Thus, each puff should contain about 0.1 to 2.5 mg of WTPM per puff, as measured on a standard smoking machine, such as a Filamatic single port smoking machine, at a 50 cc puff volume with a 30 second puff interval.

Preferably the amount of tobacco mass is increased by adjusting the size of the tobacco particles to less than 20 microns, preferably less than 10 microns, and the tobacco is compressed into the tobacco tablets used with the device of the present invention. Preferably such tobacco powder is compressed to a density of between 0.5 and 1.5 g/cc, more preferably between about 0.9 and 1.2 g/cc. Other tobacco tablets or shapes can be used which are made from larger tobacco pieces and compressed to a lower density, but as particle size goes up and density goes down, the heat conductance becomes less and less efficient, and the amount of smoke produced decreases.

In cigarette-style smoking articles in accordance with the present invention, the outer diameter of the tobacco tablet is typically about 6–14 mm, preferably about 7–10 mm, and the thickness of the compressed tobacco tablet is about 1–2 mm. In the pipe-style embodiments of the invention, success has been achieved with compressed tobacco tablets which are about 2 cm in diameter by about 0.16 cm thick, which tablets lay flat on the heated surface of a flat conductor.

The present design includes air inlets which are spaced around the circumference of the tubular piece which surrounds the tobacco and heated conductor. The air inlets are preferably located in close proximity to the tobacco in order to entrain the generated smoke as a puff is taken. The spacing and size of the air inlets are designed according to the overall dimensions of the tubular piece which surrounds the tobacco and heated conductor, in order to provide the amount of resistance to draw (pressure drop) appropriate for cigarette smoking, and the desired puff volume.

A heat conducting material is between a source of heat which heats the conductor and the tobacco. This is done to control the temperature of the surface in contact with the tobacco, to keep the temperature of the tobacco material relatively constant and within the preferred ranges below the temperature at which the device would produce smoke having Ames activity. The size and spacing of the conductor between the tobacco and heat source are designed to produce and maintain the predetermined temperature or temperature range in the tobacco material. A highly conductive material like copper or silver will deliver the heat much faster than a poor conductor. The use of a conductor having high heat conductivity is particularly helpful on initial puffs, as it is not desirable to have too long of a delay between heat initiation and smoke delivery.

Preferably the tobacco tablet is contained within a separate tubular piece which twists, screws, pressure fits or snaps on to the tubular piece holding the conductor. When put together, the two pieces form an enclosure which is essentially air tight, except for the air inlets provided for smoke delivery. The joining of the two members preferably forces the tobacco tablet into contact with the conductor.

The tubular section containing the tobacco tablet is preferably made from a material which is non-combustible at the temperatures of use, such as ceramic, metal, paper or plastic. The tobacco tube preferably also contains air inlets comprising discrete orifices or a porous matrix located in the vicinity of the tobacco tablet. This allows outside air flow to sweep past the heated tablet into the tubular section, thence to the mouthend piece and the smoke is delivered to the mouth of the smoker. The size of the air inlets, or the porosity of the matrix, is designed to deliver smoke at an acceptable pressure drop.

The smoke delivery tube is preferably designed so that it protects the smoker from excess heat exposure to the fingers. This can be achieved by using a perforated metal sleeve around the heated tube, spaced a sufficient distance from the heated tube by suitable, low-conductor, non-combustible spacers. Alternatively, the tubular section can be covered with non-conductive material, such as glass or ceramic fibers. Such a structure can be overwrapped with a variety of materials for comfort or appearance, which need not necessarily be non-combustible, provided that they are adequately separated from the flame or high temperature items by suitable non-combustible materials.

The tobacco tablet tube section leads from the tablet to the mouthend of the smoking article. There a mouthend piece is formed which permits the generated smoke to be drawn into the mouth of the smoker, while protecting the smoker's lips from uncomfortably high temperatures. The mouthend piece may be formed around a portion of the tubular tablet member, e.g. by covering the member with non-conductive or protective materials. Alternatively, the tubular tablet section can be joined to a separate mouthend piece. The mouthend piece can be formed from a non-conductive material, such as paper, plastic or wood, and has a central conduit or other means for passing the smoke to the mouth of the smoker. The mouthend piece may have a filter, preferably one of low filtration efficiency, since the smoke produced by the device contains little or nothing which should be absorbed by the filter.

The tobacco tube section may comprise a disposable paper tube, with or without an aluminum foil lining in the vicinity of the tobacco tablet. Such a tube may have the tobacco tablet at one end and a mouthpiece at the other end, which may include a filter. The use of such a device would involve the attachment of the tobacco tablet end of the tube to the conductor tube, in a manner which causes contact between the conductor and the tobacco tablet. With such an embodiment, the paper tube and spent tobacco tablet may simply be discarded after smoking.

The heat supply system or heat source can be set to cause the tobacco tablet to rapidly reach and maintain the required temperature. The preferred design uses a flame to directly and/or indirectly heat the conductor, which is in contact with the tobacco material. Preferably, the flame is generated by burning a gaseous fuel, such as butane, isobutane, propane, or mixtures thereof, preferably butane, in a gas-fired heater. Preferably, arrangements are made to contain the flame in a location where it can efficiently heat the conductor, yet is well removed from any combustible component of the smoking device. For example, the fuel burning segment of the smoking device preferably has a valve set to produce gas at a predetermined pressure and volume, so that the flame will be consistent in size and location. Other components, such as wire screen mesh, can be used to contain the flame to a desired size and location. It is preferred that the heater have a catalytic diffuser, such as a porous ceramic catalytic diffuser, as employed in commercially available butane burners, to minimize production of incomplete combustion products by the burner, and to deliver a more constant heat to the conductor.

Preferably the size, temperature and location of the heater flame are to interact with the mass of the conductor and its support structure so as to produce a very constant temperature at the side of the conductor which contacts the tobacco. For example, in at least one preferred mode of the present invention, the heater is a butane burner, having a control valve which regulates a constant flow of fuel from a refillable butane storage tank, and which limits the size and location of the flame by utilizing a catalytic wire diffuser. That diffuser is preferably located within the structure which supports the conductor, and spaced a predetermined distance from the conductor, so that the heat transfer from the burner to the conductor is constant and adequate to establish and maintain a predetermined temperature in the tobacco tablet, taking into account heat losses through the conductor, its supporting structure and the space between the conductor and the heat source.

Butane is the preferred fuel to heat the conductor, as it burns without odor and rapidly heats up the conductor. Butane provides an instantaneous heat as soon as it is ignited. Ignition is easily achieved with various piezoelectric devices which are already a part of most commercial butane lighters, torches and soldering irons. The butane heater can be made such that it is easily refillable or loaded with an exchangeable small precharged butane supply.

The tobacco tablet removed after smoking is normally the same size and shape as initial use although its weight is less because of the volatile compounds being released from the tablet during use. There are essentially no ashes formed.

In a portable device a convenient means is necessary for loading and unloading the tobacco tablet. This can be accomplished by means of joining two tubular sections one of which contains the tobacco tablet the other contains the heat supply. The two can be joined together by a tapered slip fit, threaded ends, a camming twist lock or a hinged breach block as found on rifles and shotguns and other means which would be convenient to manufacture and operate. Alternatively, the smoking device can have a slot to permit insertion of the tobacco tablet. The slot can have a separate cover, or can be opened or closed by twisting one or the other of the tubular members. The cover for the slot can alternatively be attached to the tablet itself.

The smoking device of the present invention comprises a conductor, connected to a repository for tobacco material, and a mouthend piece, the structure and conductivity of the conductor being such that, upon contact of the conductor with the heat produced from a flame, the conductor provides sufficient heat to the tobacco material in the repository to raise and maintain the tobacco material therein to a temperature within the range of about 250° C.–400° C., preferably about 280° C.–360° C., more preferably from about 285° C. to the maximum temperature at which the particular tobacco material can be exposed without producing positive Ames activity. In particular embodiments, the preferred range may differ considerably, depending on the structure of the device and the desired smoke production.

In preferred embodiments, the conductor is a cylindrical piece, which can be constructed from non-combustible materials, such as metal or ceramic materials. Suitable metal materials include steel, preferably stainless steel, copper, or silver. Preferably the conductor has a flat surface which contacts a conforming face of the tablet of tobacco. Alternatively, the conductor may have a central projection or other structure, which protrudes into or through the central portion of a toroidally shaped tobacco tablet. The configuration of the conductor should be such that the surfaces of the conductor and the tobacco tablet are substantially in contact with one another throughout their adjoining surfaces.

Preferably, the conductor is attachable to a gas flame heat source, preferably one having a refillable fuel supply, which can be used to smoke a plurality of charges of tobacco material. The flame source should deliver sufficient heat to the tobacco material to permit smoking the same at the above temperatures, and not waste inordinate amounts of heat.

Preferably, the heater has sufficient air inlets to permit the fuel to be burned cleanly, without production of partial combustion byproducts other than carbon dioxide and water. Such clean burning can also be achieved and/or improved by burning such fuels in the presence of a catalyst.

Preferably the heater is ignited by a piezo-electric igniter, which is easily actuated by a finger or thumb. The preferred structure of the heater is in the overall form of a tube, connectable at one end to the conductor, with the area adjacent the conductor being the section of the heater in which the flame is produced. Adjacent the flame section is the igniter and a device which starts, stops, and provides control of the flow of fuel. Preferred heaters are child proof, i.e., they are designed to be difficult to operate by children.

An alternate design for the tablet tube would be one which contains a separate paper tube within the metal, ceramic or high temperature plastic tube. The paper tube would be disposable, and could be replaced if it became stained or coated with condensed tobacco smoke vapors. The paper can pick up any buildup, e.g., from condensed smoke materials.

Further embodiments will be apparent to those skilled in the art from the present disclosure, which is merely exemplary of the invention to be covered by the appended claims.

DETAILED DESCRIPTION OF THE INVENTION

Figure 1:
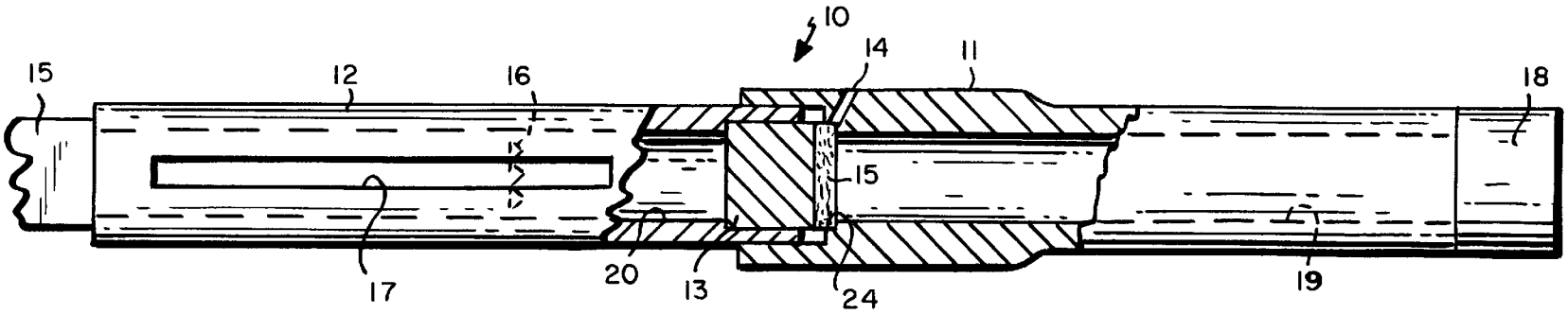
FIG. 1 is a side view, partially in section, of a cigarette-type smoking device in accordance with one embodiment of the present invention.
Figure 3:
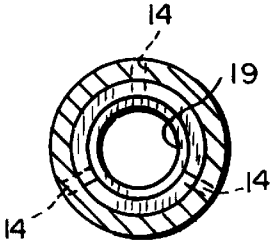
FIG. 3 is a sectional end view of the same embodiment, taken along section lines 3—3 of FIG. 2.

FIG. 1 depicts a cigarette style smoking device in accordance with the present invention. The device 10 comprises a tubular member 11 for holding the tobacco tablet 15, a tubular member 12 for holding the conductor 13 and connecting it to heat source 15. The preferred heat source 15 is a butane burner which produces a flame or flame heated catalyst at 16. The tobacco tablet tube has air inlets 14 spaced around its periphery in the vicinity of the tobacco tablet, e.g. as shown in FIG. 3, for picking up the smoke generated from the tobacco. The smoke is then delivered down the tube and through the mouthend piece 18, to the smoker. The conductor tube has open slots 17 spaced around its periphery, to provide air access to the burner 15 in the vicinity of the flame at 16.

In use, the burner 15 provides a constant source of heat at 16. Heat therefrom is transmitted to conductor 13, by infrared radiation down central passageway 20 to the back face of conductor 13, by convection of hot gas and by conduction along the conductor tube 12, which is made of steel or other conductive metal and contacts conductor 13 around its periphery. The heater 15 may be a commercially available unit, such as the burner portion of a Mini Ultra-torch® UT-50, marketed by Master Appliance Corporation, of Racine, Wis. That device burns butane gas and creates infrared heat by means of a catalytic diffuser. The device also has a valve system which permits relatively precise control of the flame height and heat produced by the unit. Alternatively, the heater may be specifically designed for use in a smoking device in accordance with the present invention. Preferably the heater has a piezoelectric igniter, in addition to adequate controls for the gas flow, and thus the amount of heat produced.

Preferably the heater has a gas flow control valve, and a catalytic diffuser and/or other means to locate the flame relatively precisely with respect to the conductor and its supporting structure, such that the heat output of the flame, and the distance between the flame and the conductor will both be constant during operation. Thus, the amount of heat transferred to the tobacco tablet remains constant, and sufficient to establish and maintain the tobacco at a predetermined temperature throughout the period of smoking, as described above. Typically the period of smoking until the tobacco is depleted may last from 2 to 10 minutes, but that time can be varied, depending on the amount and the type of tobacco used, as well as the efficiency of the heating system, and the propensities of the individual smoker.

Conductor 13 is preferably made of copper, silver, or other highly conductive metal. Because of its mass, as well as that of the conductor tube 12, and the constant heat supply by the burner at 16, conductor 13 maintains a temperature which is substantially constant over the time period of smoking. The system is designed, taking into account the temperature of the heater flame, the distance of the flame from the conductor 13, and the mass and structure of the conductor and the conductor tube 12, so that the tobacco material is maintained at a temperature within the range of about 250°–400° C., preferably about 280°–360° C., more preferably from about 285° C. to the maximum temperature at which the particular tobacco material can be exposed without producing significant Ames activity.

Figure 2:
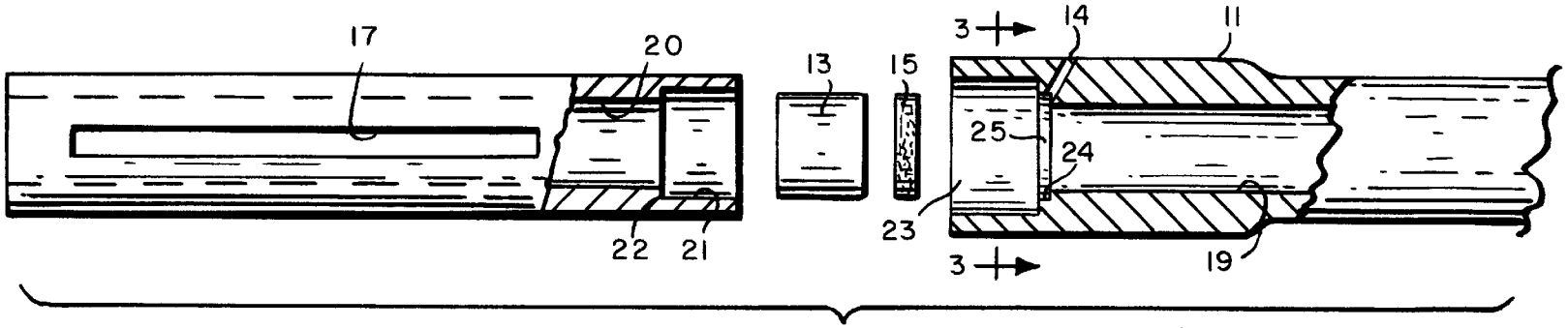
FIG. 2 is an exploded view of the embodiment depicted in FIG. 1.

The tablet tube 11 and the conductor tube 12 are fit together, e.g. by a pressure fit, e.g., between the outer surface of conductor tube 12 and the inner surface of chamber 23 in tablet tube 11, in such a manner that the forward face of conductor 13 is pressed against the back face of tobacco tablet 15. That contact, together with the size and density of the tobacco tablet 15, ensures that the tobacco tablet is likewise maintained at approximately the temperature of the conductor 13. As further clarified in FIG. 2, the forward portion of tobacco tablet 15 fits into chamber 25 in tablet tube 11. The tobacco tablet is prevented from further protruding into passage 19 by the shoulder 24 of chamber 25. If desired, the forward face of tablet 15 can also be supported by a pervious support, such as a screen, located at the forward end of chamber 25, preferably at about the location of shoulder 24. Such a support should be pervious to the smoke produced by the tobacco tablet, in order to permit such smoke to be picked up by the air drawn through inlets 14, carried through such support and to the mouth of the smoker.

The mouthend piece should be a non-conductive structure, or coated or covered with a non-conductive structure, so that the lips of the smoker are protected from any undue heat. The mouthend piece may comprise a wooden tube, joined to the steel tobacco tablet tube by a high temperature adhesive. Preferably the mouthend piece can comprise a filter piece, e.g., a cellulose acetate filter piece, attached to the tobacco tablet tube by adhesive or by overwrapping of cigarette or other paper. The mouthend piece may be made or covered with non-conductive materials, such as paper, wood, plastic, carbon, or other non-conductive material.

At the treatment temperatures required in accordance with the present invention, the tobacco tablet produces substantial amounts of smoke. When the smoker draws on the mouthend of tablet tube 11, air is drawn in through inlets 14, contacts the heated tobacco tablet 15, picks up the smoke being generated thereby, and carries the smoke down central passageway 19 to the smoker.

The size and number of the inlets 14 are adjusted to provide the smoker with appropriate draw resistance, e.g. comparable to the draw resistance provided by most commercial cigarettes.

The size and number of slots 17 in conductor tube 12 can be varied, but should be sufficient to promote complete combustion of the fuel burned by the heater 15. Other shaped openings, such as peripheral circular holes, may be used instead of the slots 17, if desired.

The components of the overall device may be attached in line to form a generally straight cylinder, as depicted in FIG. 1, or may have some aspect disposed at an angle to the remainder of the structure. For example, the part of the gas heater which includes the fuel tank and the piezo electric igniter may be set at an angle to the remainder of the article, for ease in handling of the smoking device.

Figure 4:
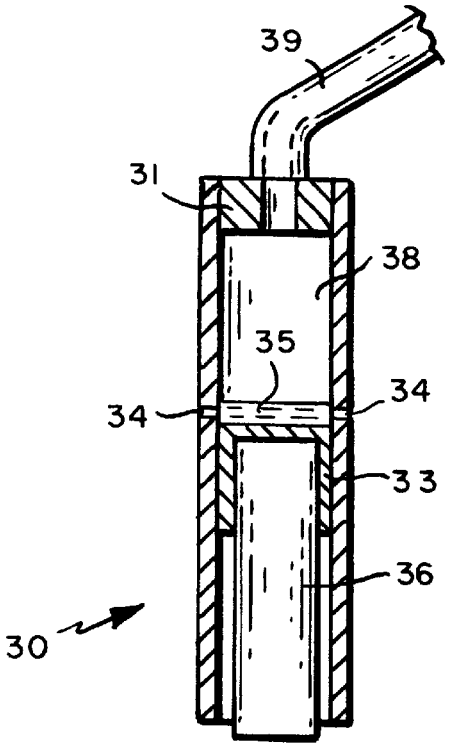
FIG. 4 is a plan view of a smoking device constituting another embodiment of the present invention.

FIG. 4 depicts an alternate embodiment of the present invention, in which the tobacco tablet 35 is supported upon a cylindrical conductor 33, above a source 36 of constant heat provided to maintain the conductor at a substantially constant temperature within the range of about 250°–400° C., preferably about 280°–360° C., more preferably within the range from about 285° C. to the maximum temperature at which the particular tobacco material can be exposed without producing positive Ames activity.

When a smoker puffs the device shown in FIG. 4, air passes through inlets 34 to contact the tobacco tablet 35 and pick up the smoke generated therefrom. The smoke then traverses chamber 38 and through mouthpiece 39, to the smoker.

Figure 5:
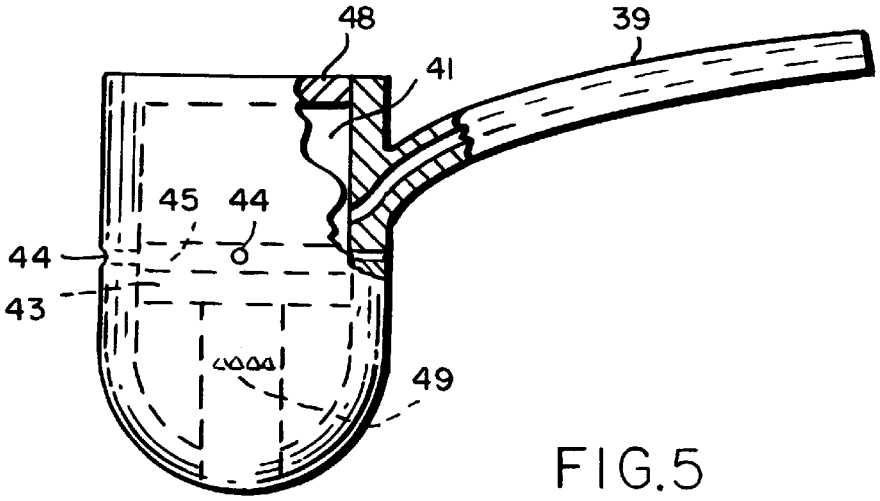
FIG. 5 is a side view, partially in section, of a pipe-type smoking device in accordance with another embodiment of the present invention.

FIG. 5 depicts in schematic fashion a pipe-style smoking device made in accordance with the present invention. This structure is generally similar to the device shown in FIG. 4. Thus pipe bowl 40 includes supports for conductor 43, which, in turn bears tobacco tablet 45. The bowl is similar to known pipe bowls, but the top of the pipe is closed by a cover 48 to form closed smoke chamber 41.

The source of constant heat and temperature 49 in the FIG. 5 device is preferably a gas burning heat source, such as previously described.

When a smoker puffs the device shown in FIG. 5, air passes through inlets 44 to contact the tobacco tablet 45 and pick up the smoke generated therefrom. The smoke then traverses chamber 41 and through mouthpiece 39 to the smoker.

EXAMPLE 1

Tobacco tablets were produced from tobacco that was ground into a powder, compressed to high density, and heated at a constant and uniform temperature in a smoke generation apparatus having the general construction depicted in FIG. 4 hereof. The apparatus was designed to be able to heat tobacco in the form of a tobacco tablet, from about 100 to 500 degrees centigrade. The heater was a Chromalox CIR-5023 ¾ inch diameter by 2⅜ in. cartridge heater (Wigland Industrial Division, Emerson Electric Co., Pittsburgh, Pa.), with an output capacity of 200 W at 120 v. The conductor was made of steel, 0.25 in. thick, fit over the end of the cartridge heater. The outer tube was made of steel, with four inlet holes, each about 0.04 inch in diameter, equally spaced around its periphery at the level of the tobacco tablet. The temperature was measured contiguous at the surface of the conductor, and controlled by controlling the current to the cartridge heater.

Tobacco tablets were made from cigarette dust, as described previously, that was ball-milled for about three hours, to produce a particle size (average particle diameter) of about 10 microns. The resulting tobacco powder was compressed under about 10,000 pounds (about 21,400 psi) to tablets having an average diameter of 1.96 cm., an average thickness of 0.165 cm, having a density of about 1.01 g/cc, and contained about 0.5 g. of tobacco powder per tablet. The compressed tobacco tablets were smoked at constant temperatures of 285° C., 310° C. and 335° C., respectively.

Smoke condensates from the tobacco tablets smoked at the different temperatures were generated using a Filamatic single port smoking machine at a 50 cc puff volume with a 30 second puff interval. A total of ten (10) puffs were taken per tablet, and the resulting condensates were collected on filter pads. The total particulate matter (TPM), amount of water and amount of nicotine produced by the samples were measured as follows:

TABLE I

| Test | Temp. | TPM (mg) | Water (mg) | Nicotine (mg) |
|---|---|---|---|---|
| 1 | 285 | 15.5 | 6.46 | 1.87 |
| 2 | 310 | 18.9 | 8.14 | 1.80 |
| 3 | 335 | 26.3 | 12.19 | 1.45 |

The smoke condensate samples from the three different temperatures were then tested using the standard Ames test with a preincubation modification [see e.g., Ames et al., *Mut. Res.* 31:347–64 (1975) and Yagahi et al. Cancer Lett. 1:91–97 (1975)]; as described below.

Ten (10) tablets were smoked per pad for analysis of the smoke condensate. Approximately 155 mg of condensate was trapped on the pad at the 285° C. smoking temperature, which equates to about 15.5 mg. of WTPM per tablet (or cigarette equivalent). The filter pad for each test was shaken for 25 minutes in DMSO to dissolve the collected condensates. Each sample was then diluted to a series of concentrations.

For the samples in Table I, the following concentrations were prepared and 50 μls of each was used on triplicate plates for each concentration and used in the Ames assay.

TABLE II

| Final μg TPM/plate | Concentration solution (used 50 μl/plate) |
|---|---|
| 0 | solvent control (50 μl of DMSO) |
| 54 | 1.08 mg/ml |
| 107 | 2.14 mg/ml |
| 161 | 3.22 mg/ml |
| 215 | 4.30 mg/ml |
| 268 | 5.36 mg/ml |
| 536 | 10.72 mg/ml |

Ames mutagenicity testing was carried out as described below, which is in accordance with B. R. Bombick et al., *Food & Chemical Toxicology* 36:183–190 (1998), using the *Salmonella* microsome assay of D. M. Maron et al. *Mutation Research* 113:247–56 (1983), with the preincubation modification described by T. Yahagi et al., *Cancer Lett.* 1:91–97 (1975). *Salmonella typhimurium*, strain TA 98 (see Purchase et al., *Nature* 264:624–27 (1976)) was used in the presence of metabolic activation using S9 liver homogenate obtained from Mol-Tox Corp. of Boone, N.C., prepared according to B. N. Ames et al., *Mutation Research* 31:347–64 (1975), from male Sprague-Dawlet rats that were given a single 50 mg/kg injection, ip, of Aroclor 1254. The S9 concentration in S9 mix was 5%(v/v), and 0.5 ml of the S9 mix was added per plate. Concurrent negative and positive controls were performed with all experiments. All testing was conducted by using triplicate plates at each concentration. A sample was considered to be mutagenic if it induced a concentration-dependent increase in revertant number with at least one concentration being at least twice the solvent control.

The condensate samples were tested separately with S9 metabolic activation at dosages of 0–536 μg of condensate total particulate matter (TPM) per plate. Samples having various concentrations of condensate were admixed with the S9 activating system, plus the standard Ames bacterial cells, and incubated at 37° C. for twenty minutes. Top agar was then added to the mixture, and the top agar mixture was poured onto minimal glucose agar plates. The agar plates were incubated for two days at 37° C., and the revertants were counted. Three plates were run for each dilution, and the average revertants were compared against a pure DMSO control culture. As shown in Table III, there was no mutagenic activity caused by the condensates obtained from any of the tobacco tablets smoked at the temperatures of 285° C.–335° C. This can be ascertained by comparison of the mean number of revertants per plate with the mean number of revertants obtained from the control (0 μg/plate). For positive Ames results, the mean number of revertants per plate will increase with increasing doses. The results are shown in Table III:

TABLE III

| | Dose (μg TPM/plate) | Mean Revertants/plate | S.D.* |
|---|---|---|---|
| SAMPLE 1 - Smoked at 285° C. | | | |
| Control | 0 | 20.7 | 0.6 |
| | 54 | 21.3 | 3.2 |
| | 107 | 25.0 | 0.0 |
| | 161 | 24.0 | 1.0 |
| | 215 | 20.3 | 1.5 |
| | 268 | 24.3 | 2.5 |
| | 536 | 26.0 | 1.7 |
| SAMPLE 2 - Smoked at 310° C. | | | |
| Control | 0 | 22.0 | 2.6 |
| | 54 | 21.0 | 2.6 |
| | 107 | 22.3 | 1.5 |
| | 161 | 24.7 | 1.2 |
| | 215 | 24.0 | 1.7 |
| | 268 | 23.7 | 0.6 |
| | 536 | 23.3 | 0.6 |
| SAMPLE 3 - Smoked at 335° C. | | | |
| Control | 0 | 20.7 | 2.1 |
| | 54 | 23.3 | 0.6 |
| | 107 | 20.3 | 2.3 |
| | 161 | 23.0 | 0.0 |
| | 215 | 21.3 | 2.5 |
| | 268 | 23.3 | 4.5 |
| | 536 | 20.0 | 3.5 |

*Standard Deviation

Using this approach, any particular tobacco or tobacco material may be evaluated for production of substantial smoke product over a range of temperatures, to determine the range of temperatures which do not produce positive Ames results for any given tobacco or product configuration.

EXAMPLE 2

The same test was run as in Example 1, except that the test was run with a smaller apparatus, still having the configuration of FIG. 4. The heater used was a Chromalox CIR-2015 ⅜ inch by 1.5 inch cartridge heater (Wigland Industrial Division, Emerson Electric Co., Pittsburgh, Pa.), with an output capacity of 200 W at 120 v. The outer tube was again of steel, but three inlet holes were spaced equidistantly around the periphery at the level of the tobacco tablet. The test used only about half the amount of tobacco powder—about 0.25 g. per tobacco tablet, rather than the 0.5 g. per tablet in Example 1. The resulting tobacco powder was compressed under about 5,000 pounds (about 44,100 psi) to tablets having an average diameter of 0.965 cm., an average thickness of 0.305 cm, having a density of about 1.12 g/cc, and containing about 0.25 g. of tobacco powder per tablet. The compressed tobacco tablets were smoked at constant temperatures of 285° C., 310° C., 335° C. and 360° C., respectively. The results are shown in

TABLE IV

| Test | Temp. | TPM (mg) | Water (mg) | Nicotine (mg) |
|---|---|---|---|---|
| 4 | 285 | 7.4 | 3.14 | 0.64 |
| 5 | 310 | 7.9 | 3.67 | 0.53 |
| 6 | 335 | 7.7 | 3.06 | 0.39 |
| 7 | 360 | 7.8 | 3.86 | 0.36 |

For the samples in Table IV, the following concentrations were prepared and 50 μl of each was used on triplicate plates for each concentration and used in the Ames assay.

TABLE V

| Final μg TPM/plate | Concentration solution (used 50 μl/plate) |
|---|---|
| 0 | solvent control (50 μl DMSO) |
| 25 | 0.5 mg/ml |
| 50 | 1.0 mg/ml |
| 75 | 1.5 mg/ml |
| 100 | 2.0 mg/ml |
| 125 | 2.5 mg/ml |
| 250 | 5.0 mg/ml |

TABLE VI

| | Dose μg TPM/plate) | Mean Revertants/plate | S.D.* |
|---|---|---|---|
| SAMPLE 4 - Smoked at 285° C. | | | |
| Control | 0 | 27.7 | 1.2 |
| | 25 | 23.7 | 6.0 |
| | 50 | 23.3 | 1.2 |
| | 75 | 30.0 | 2.0 |
| | 100 | 22.7 | 2.5 |
| | 125 | 21.0 | 6.9 |
| | 250 | 20.7 | 2.1 |
| SAMPLE 5 - Smoked at 310° C. | | | |
| Control | 0 | 23.0 | 4.4 |
| | 25 | 28.0 | 6.2 |
| | 50 | 23.0 | 2.6 |
| | 75 | 20.0 | 3.6 |
| | 100 | 24.7 | 1.2 |
| | 125 | 24.3 | 2.1 |
| | 250 | 23.0 | 1.0 |
| SAMPLE 6 - Smoked at 335° C. | | | |
| Control | 0 | 20.3 | 0.6 |
| | 25 | 22.3 | 5.8 |
| | 50 | 22.3 | 2.5 |

TABLE VI-continued

| | Dose μg TPM/plate) | Mean Revertants/plate | S.D.* |
|---|---|---|---|
| | 75 | 22.7 | 6.1 |
| | 100 | 23.3 | 4.9 |
| | 125 | 22.7 | 1.5 |
| | 250 | 22.7 | 2.5 |
| SAMPLE 7 - Smoked at 360° C. | | | |
| Control | 0 | 22.3 | 4.2 |
| | 25 | 20.0 | 1.0 |
| | 50 | 25.0 | 3.5 |
| | 75 | 23.7 | 4.9 |
| | 100 | 27.3 | 1.5 |
| | 125 | 23.7 | 0.6 |
| | 250 | 28.0 | 2.6 |

*Standard Deviation

Thus it can be seen that the present invention provides improved smoking articles and methods, which provide the smoker with a substantial amount of pure tobacco smoke flavor and satisfaction, yet at the same time does not produce controversial combustion byproducts which generate positive Ames activity.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A method of smoking, comprising a. heating compressed tobacco powder at a substantially constant temperature to produce smoke;

b. the temperature being between 250° C. and a temperature which is the maximum temperature to which the tobacco can be exposed without producing Ames activity, and c. delivering the resulting smoke to a smoker; wherein the compressed tobacco powder is in the form of a tablet.

2. The method of claim 1, wherein the compressed tobacco powder is powder which has been milled to a desired particle size.

3. The method of claim 2, wherein the tobacco powder has a particle size of less than 20 microns prior to compression.

4. The method of claim 3, wherein the tobacco powder has a particle size of less than 10 microns prior to compression.

5. The method of claim 3, wherein the tobacco powder is compressed to a density of about 0.9 to about 1.2 g/cc.

6. The method of claim 3, further comprising contacting the heated tobacco with fresh air, to entrain smoke produced by such heated tobacco.

* * * * *